US006840709B2

(12) United States Patent
Dahlem et al.

(10) Patent No.: US 6,840,709 B2
(45) Date of Patent: Jan. 11, 2005

(54) DISTRIBUTED NATURAL GAS STORAGE SYSTEM(S) USING OIL & GAS & OTHER WELL(S)

(76) Inventors: David Fred Dahlem, 23 Franklin Woods Rd., Somers, CT (US) 06071; Michael Feodorov, 69 Snow Ridge North, Middletown, CT (US) 06457

( * ) Notice: Subject to any disclaimer, the term of this patent is extended or adjusted under 35 U.S.C. 154(b) by 0 days.

(21) Appl. No.: 10/341,183

(22) Filed: Jan. 13, 2003

(65) Prior Publication Data

US 2004/0136784 A1 Jul. 15, 2004

(51) Int. Cl.[7] ..... B65G 5/00
(52) U.S. Cl. ..... 405/53; 405/55
(58) Field of Search ..... 405/52–59

(56) References Cited

U.S. PATENT DOCUMENTS

| | | | |
|---|---|---|---|
| 4,858,640 | A | 8/1989 | Kaufmann |
| 5,207,530 | A | 5/1993 | Brooks et al. |
| 5,333,465 | A | 8/1994 | McBride |
| 5,803,005 | A | 9/1998 | Stenning et al. |
| 5,839,383 | A | 11/1998 | Stenning et al. |
| 6,003,460 | A | 12/1999 | Stenning et al. |
| 6,412,508 | B1 | 7/2002 | Swann, Jr. |
| 6,581,618 | B2 | 6/2003 | Hill et al. |

*Primary Examiner*—Frederick L. Lagman
(74) *Attorney, Agent, or Firm*—Dickstein Shapiro Morin & Oshinsky LLP

(57) ABSTRACT

The present invention revolves around the incorporation and use of existing drilled wells, either dry holes, abandoned or converted producing wells and/or new, to be drilled wells or any other well(s), of any diameter and any depth, located, sited, designed and fabricated to store and cycle compressed natural gas or other gasses or hydrocarbon liquids within the contained cavity of the well-bore casing in any volume and with any degree (high or low) of deliverability.

Each of the well(s) can then be incorporated with additional facilities, depending upon designed use and process (use and process as discussed within the patent application), such as standard telemetry, automation and integration equipment, compressors, pressure reducing regulators, turbo-compressors (for electrical and or mechanical power creation), distributed power generator engines, measurement equipment and other components for compressing and storing the gas or hydrocarbon liquids within the system at a range of rates, and then cycling the gas out of the well(s) for a number of business applications. The well(s) can also be incorporated with standard electronic communication devices to automate and integrate them within other systems such that they can be controlled remotely and automatically from any location.

32 Claims, 3 Drawing Sheets

PLOT PLAN

DISTRIBUTED NATURAL GAS STORAGE SYSTEM(S) USING OIL & GAS & OTHER WELL(S)

BACKGROUND AND SUMMARY OF THE INVENTION

The present invention relates to the new use of drilled wells to store and cycle compressed natural gas or other gasses within a specifically designed system(s) whereby the compressed gas is contained within the cavity of the well-bore casing and not permitted to be forced through any well-bore casing perforations into the surrounding underground formation due to the fact that the cased well-bore is sealed at the lower end.

Generally, oil & gas wells are usually drilled to significant depths (greater than 3,000 feet) and then plugged, if dry, or eventually abandoned once production of oil and/or gas stops.

This invention revolves around the use of existing drilled well(s), either dry holes, abandoned or converted producing wells and/or new, to be drilled, well(s) or any other well(s) located, sited, designed, drilled and fabricated to store and cycle compressed natural gas or other gasses to and from the sealed well-bore, in any volume and rate and with any degree (high or low) of deliverability for numerous industry and commercial purposes. Thus, the present invention relates to a new and unique natural gas storage and cycling system and process. There are literally hundred's of thousand's of oil & gas wells already in existence within the United States. For instance, since the first Drake well was drilled in Pennsylvania in 1859, approximately 325,000 wells have been drilled in Pennsylvania, approximately 70,000 wells in New York and approximately 1.1 million in Texas. Thus, there is excess capacity and this invention will put some of this excess capacity, with little to no current economic value to society, located throughout the United States and the World, back to better economic use. In fact, many of these wells are located near or within the delivery systems and the consumer. This will increase bottom line economics of the delivery system infrastructure across the board and mitigate adverse impacts on the environment associated with new construction.

In light of the growing significance and use of natural gas in the United States and the World due to its environmentally clean nature, it has increasingly become the fuel of choice for consumers. These consumers include, but are not limited to, residential, commercial, industrial and power generators. The increased demand has and will continue to put stress on the delivery systems involving but not limited to, interstate and intrastate pipelines, local distribution companies and traditional under-ground storage operators. These delivery systems are continually seeking to construct and expand their respective systems to accommodate this increase in demand. This expansion need has a direct impact on the environment due to construction.

Additionally, the current delivery systems are also attempting to accommodate the "PROFILING" (ie: non-uniform hourly consumption—sometimes referred to as load-following) requirements of each of the ultimate consumers. That is, delivery systems generally deliver gas on a uniform $1/24^{th}$ basis and consumption does not actually occur in that manner. Consumption can, and generally does, occur on a non-uniform basis. This places even greater demands on the delivery systems and results, at times, in penalties, curtailments, restrictions and general over-building of delivery systems and resulting environmental impacts. Delivery system operators are currently attempting to expand through new construction and are developing new rate/cost structures to accommodate non-uniform hourly consumption. These actions will only serve to increase costs and increase in-efficiencies. The present invention will serve to decrease costs and increase efficiencies and optimize the use of the existing delivery system infrastructure.

The present invention increases efficiencies and optimizes the infrastructure and provides for an economical system and method to accommodate PROFILING. It creates storage, mechanical and electrical power and the cooling affect of expanding gas when released or cycled out of the facility can be harnessed and utilized to create air-conditioning, chilled water and increase the operating efficiencies at switch yards and electrical transformers. It can also be harnessed and utilized to increase operating efficiencies at power generation turbines and other engines and other applications and used in the production of industrial gasses and ice.

In light of the fact that the invention involves and utilizes existing drilled oil and gas wells and/or newly drilled well(s), these systems can be located with little harm to the environment at critical points within the delivery system(s) infrastructure (ie: existing transfer stations), or as determined by industry and consumers. This action will then allow a reduction in costs and increased operating efficiencies.

FIG. 1 is a schematic, profile illustration of a newly drilled well or an existing drilled oil and gas well in which the well-bore has been fitted with a string of high pressure steel casing. This is standard drilling and production practice. The cased well-bore can also contain and be used to cycle compressed gasses, hold and maintain significant high pressures, without loss, depending upon the yield strength of the steel casing fitted within the well-bore and the formation pressures acting on the steel casing at various depths.

For example, a local distribution company (LDC) could locate these systems (FIGS. 2, 3) within their delivery franchise area to provide peak storage, air-conditioning, generate peak power and provide PROFILING services.

This installation would be of benefit to the rate payers of the LDC as it would result in overall lower costs, increased efficiencies and increased abilities to meet growing needle peaks and needle balancing. Thus, this system could become part of the rate base of an LDC while mitigating costly pipeline capacity charges, penalties and peak shaving costs.

Also, for example, a power generator could utilize this system (FIGS. 2, 3) to provide gas to its turbines on a non-uniform basis significantly reducing its transmission charges and mitigating its exposure to potential transmission system imposed penalties, restrictions and/or curtailment. The system could also be used to harness the cooling affect of the expanding gas to enhance the operating efficiency of its power generation turbines or engines.

Also, for example, a intrastate or interstate transmission pipeline could utilize the system (FIGS. 2, 3) to increase their ability to provide PROFILING services, increase capacity and reduce costs associated with the cooling of gas at the discharge side of compressors (ie: after cooler costs). The incorporation of turbo-expanders will also be of benefit to increase efficiencies of the turbine.

Also, for example, a direct commercial, residential or industrial consumer could utilize the system (FIGS. 2, 3) to store gas, provide their own PROFILING services, create electrical power through turbo-expanders or other generators or engines, and create their own air-conditioning and/or industrial gasses or ice or other products, such as chilled water, from the cooling affect associated with expanding gas.

Also, for example, operators of electrical switch yards and transformers could utilize the system (FIGS. 2, 3) to harness the cooling affect of expanding gas during peak electrical demand days to increase the efficiency of these facilities.

Also, for example, storage operators could utilize this system (FIGS. 2, 3) to begin to offer PROFILING services to its customers as third party balancing agents. These systems, for example, could also be fitted with TURBO-GENERATORS, to provide peak electrical power generation at the same time there is a need to provide needle balancing or PROFILING to its customers or to provide on-site power needs. The system can also be utilized to create hourly electrical power when commodity spreads and/or needs merit.

Also, for example, power plant operators and others could utilize this system (FIGS. 2, 3) to comply with environmental regulations requiring them to cool heated water that is heated during the plant operation prior to it being discharged into the environment or other holding facility.

For any and/or all examples addressed above, the well(s) and system can also be incorporated with electronic communication devices to automate them such that they can be controlled remotely and automatically from any location. This could also potentially require the system (distributed storage using well(s)) to be incorporated into other gas transmission or delivery systems such as, but not limited to, direct end-user delivery lines, local distribution systems, interstate pipelines and traditional under ground natural gas storage facilities to enhance operational efficiencies and uses.

Additionally, the well-bore of the well(s) (Existing and/or new, to be drilled) consisting of the invented system may or may not also be fitted with expandable casing (Enventure—a Joint Venture between Shell and Halliburton) to reseal perforations or otherwise contain compressed natural gas within the well-bore at low and high or any variety or range of operating pressures which may change quite often due to cycling and depending on the specific system process design as further discussed and contained within this patent application.

The present invention provides a system and method for the use and storage of compressed natural gas within existing oil and gas wells, either dry holes, abandoned or converted producing wells and/or new, to be drilled, wells or any other well(s) located, sited, designed, drilled and fabricated to store and cycle compressed natural gas or other gasses within the contained cavity of the well-bore casing in any volume and with any degree (high or low) of deliverability.

Each of the well(s) can then be incorporated with additional facilities, depending upon designed use and process, such as compressors, pressure reducing regulators, heat exchangers, temperature absorbers, turbo-compressors (for electrical and/or mechanical power creation), distributed power generator engines, in-line measurement equipment and other components for compressing and storing the gas within the system at a range of rates, and then cycling the gas out of the well(s) for a number of business applications, including but not limited to, industrial & commercial, & residential use, consumption and profiling of gas requirements, power generation use, consumption and profiling of gas needs, local distribution company use, consumption and profiling of gas needs, interstate pipeline use, consumption and profiling of gas needs, creation of air conditioning, industrial gasses and ice, enhancing the efficiency of switch yards, electrical transformers, compressors and other business and non-business applications. The system design would incorporate all components required to operate within the parameters of its designed utilization and within the operating parameters of any system(s) it may be incorporated in a safe and environmentally acceptable manner.

Depending on the specific process and/or business application, which are numerous, associated with the well(s) and the total created system (distributed storage using well (s)), each system configuration will be subject to change, however, the constant component's will always be the incorporation of the well(s) within the system(s) and the connected processes and business and non-business uses contained within this patent application.

In another embodiment, the well(s) are existing drilled well(s), either dry holes, abandoned or actively producing wells and/or new, to be drilled, well(s) or any other well(s) located, sited, designed, drilled and fabricated to store and cycle compressed gasses, such as hydrogen or other compressible gasses and/or hydrocarbon liquids, in any volume and with any degree (high or low) of deliverability for numerous industry and commercial purposes and processes as detailed within this patent application. Additionally, the invention and system can be located slightly below grade. Thus, the present invention relates to a new and unique natural gas storage system and process.

In the presently preferred embodiment, the well(s) are existing drilled well(s), either dry holes, abandoned or actively producing wells and/or new, to be drilled, well(s) or any other well(s) located, sited, designed, drilled and fabricated to store and cycle compressed natural gas, in any volume and with any degree (high or low) of deliverability for numerous industry and commercial purposes and processes as detailed within this patent application. There can be one or more wells involved in the system and the system can be located above or below grade. Thus, the present invention relates to a new and unique natural gas storage system and process.

The inventor knows of no other similar method and processes to store natural gas other than in underground reservoirs, cylinders or tubes at a vehicular fueling center for natural gas vehicles, on ships and land for purposes of transporting and storing natural gas in serpentine tubular coils and horizontally positioned steel pipes which are placed above ground or in shallow trenches. The tubes are located either above ground or placed in shallow trenches whereby they can be stacked in horizontal layers. These other facilities are described in U.S. Pat. Nos. 4,858,640, 5,207,530, 5,333,465, 5,803,005, 5,839,383, 6,003,460 and 6,412,508.

The facilities described for use at vehicular fueling centers are described in U.S. Pat. No. 5,333,465. This Patent teaches the storage of natural gas at extremely high pressure, in excess of 5,000 psi, in relatively shallow wells, 500 to 1,000 feet. These wells are drilled by conventional water well drilling trucks and the well-bore is cased with conventional water well casing. Natural gas is then compressed and stored in high pressure tubes that are fit into the shallow well-bore. These high pressure tubes contain the natural gas under about 8,000 psi.

Our invention, involves significantly different and unique systems and processes. One, our invention incorporates the use of existing oil and gas and/or new, to be drilled, wells that are significantly different than water wells. Secondly, our invention stores and cycles gasses into and from, the steel cased well-bore that is sealed at the lower end and not in individual steel tubes that are lowered into conventional, low pressure, water well casing. Also, our invention relates to a system that can be used, in part, for rapid cycle balancing and storage, needle peaking, profiling, peak electrical power generation, creation of industrial gasses and ice, enhancing efficiency of turbines and electrical system components and for heat exchange benefits. Clearly, the invention is not solely a vehicular fueling center storage system.

While the invention has been described in connection with what is presently considered to be the most practical and preferred embodiment as detailed within FIGS. 1, 2 and 3, it is to be understood that the invention is not to be limited to the disclosed embodiment, but on the contrary, is intended to cover various modifications and equivalent arrangements included within the spirit and scope of the appended claims.

BRIEF DESCRIPTION OF THE DRAWINGS

These, as well as other objects and advantages of this invention, will be more completely understood and appreciated by careful study of the more detailed description of the presently preferred exemplary embodiments of the invention taken in conjunction with the accompanying drawings, in which.

DETAILED DESCRIPTION OF THE INVENTION

The present invention relates to the new use of drilled oil and gas, or new, to be drilled wells to store and cycle compressed natural gas or other gasses within a specifically designed system(s) whereby the compressed gas is self-contained within the cavity of the well-bore casing and not permitted to be forced through any well-bore casing perforations into the surrounding underground formation due to the fact that the cased well-bore is sealed.

Generally, oil and gas wells are usually drilled to significant depth, greater than 3,000 feet, and then plugged, if dry, or eventually abandoned once production of oil and/or gas stops.

This invention revolves around the use of existing drilled oil and gas well(s), either dry holes, abandoned or converted producing wells and/or new, to be drilled, well(s) or any other well(s) of any depth and any diameter, located, sited, designed, drilled and fabricated to store and cycle compressed natural gas or other gasses, in any volume and with any degree (high or low) of deliverability for numerous industry and commercial purposes. Thus, the present invention relates to a new and unique natural gas storage system and process.

Natural gas delivery system operators are always seeking to expand through construction and are also currently attempting to develop new rate/cost structures to accommodate PROFILING and balancing. These actions will only serve to further increase costs and increase in-efficiencies. The present invention will serve to decrease costs and increase efficiencies and optimize the use of the existing overall delivery system infrastructure.

The present invention increases efficiencies, mitigates costs and optimizes the infrastructure and provides for an economical system and method to accommodate PROFILING and balancing.

The present invention also creates storage, mechanical and electrical power and the cooling affect of expanding gas when released or cycled out of the facility can be harnessed and utilized to create air-conditioning, chilled water and increase the operating efficiencies at electrical switch yards and electrical transformers. It can also be harnessed and utilized to increase operating efficiencies of power generation turbines and other engines and other applications and used in the production of industrial gasses and ice.

In light of the fact that the invention involves and utilizes existing drilled well(s) and/or newly drilled well(s), these systems can be located with little harm to the environment at critical points within the delivery system(s) infrastructure, as determined by industry and consumers. This action will then allow a significant reduction in costs and increased operating efficiencies throughout the overall delivery infrastructure.

Figure 1:
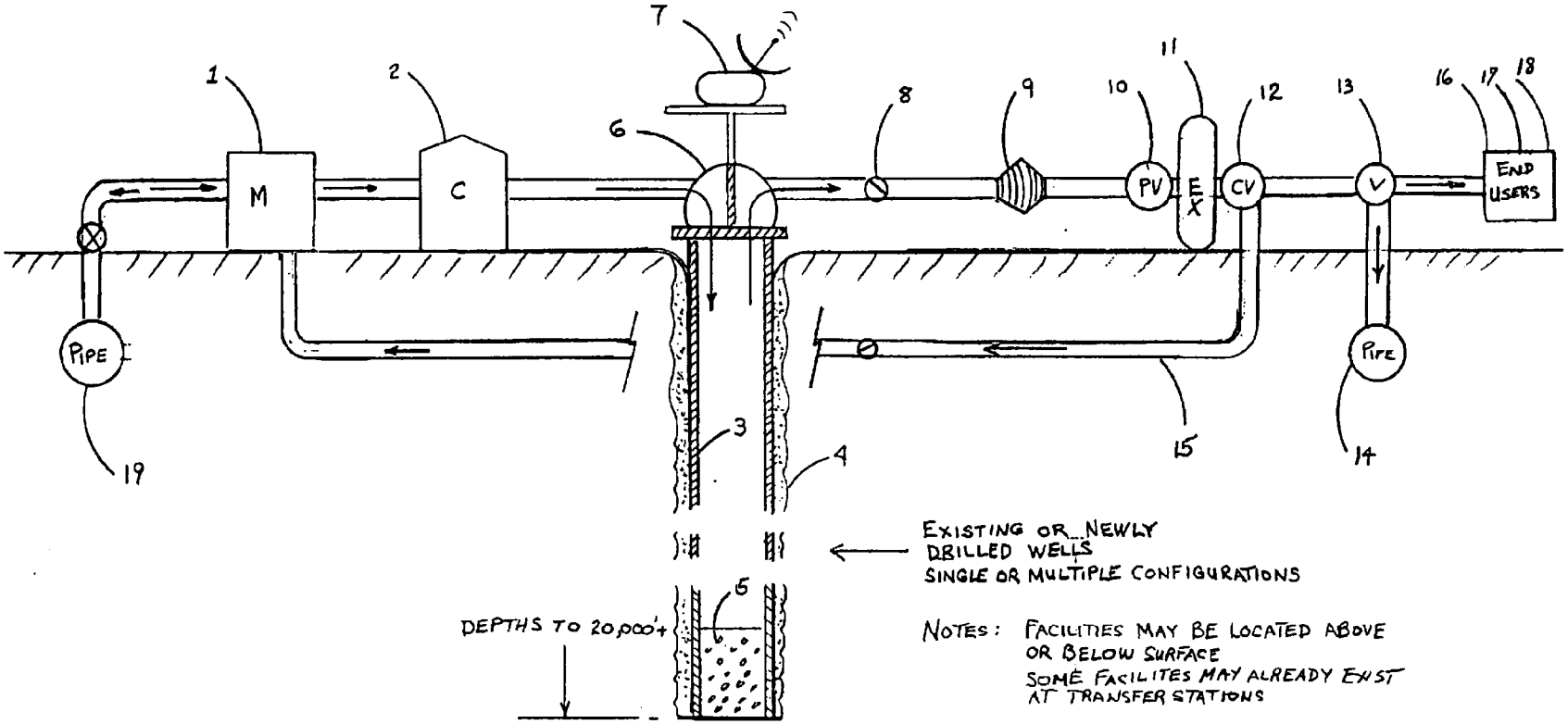
FIG. 1 is a schematic, profile illustration of a typical drilled oil or gas well in which the well-bore has been fitted with a string of high pressure steel casing. The cased well-bore can also contain compressed gasses that can be cycled to and from the well-bore, hold and maintain significant high pressures, without loss, depending upon the yield strength of the steel casing fitted within the well-bore and the formation pressures acting on the steel casing at various depths.

With reference to FIG. 1, a first embodiment of the invention will be described in greater detail. FIG. 1 is a profile illustration of a typical drilled oil and gas, or other new to be drilled well, in which the well-bore 3 has been or will be fitted with a string of high pressure steel casing. The cased well-bore 3 can also contain compressed gasses that can be cycled to and from the well-bore 3, hold and maintain significant high pressures, without loss, depending upon the yield strength of the steel casing fitted within the well-bore and the formation pressures acting on the steel casing at various depths.

In general, gas flows from a source 19 through measurement and metering facilities 1. This is also generally a point of custody or title transfer. The gas then flows to an optional compressor 2 designed with sufficient power to force and compress gas into the well-bore 3. At the inlet of the well-bore 3, the gas will flow through control valves 6 designed to permit gas to enter, exit or be contained within the well-bore 3. The system and all valves and controllers are automated through the use of standard telemetry equipment 7 such that the system is automated and can be controlled from remote locations. The well-bore 3 can be of any diameter and/or any depth and is lined with steel casing. The lower end 5 of the well-bore 3 is sealed through the use of cement or other standard industry plugs. The annulus 4 is filled, partially or wholly, with cement or other inert, environmentally acceptable fluid(s) such as standard drilling mud. Upon cycling of gas out of the well-bore 3, gas flows through the control valves 6 and through a check valve 8 and an optional turbo expander 9 to create power. The gas flows through standard pressure control and over pressure protection valves 10 and an exchanger/heater 11 is utilized to capture the cold energy created by the rapid, but controlled, expansion of the gas or to reheat the gas, if necessary. The gas is then directed to other systems for consumption and/or use as described in FIG. 2 and FIG. 3.

Figure 2:
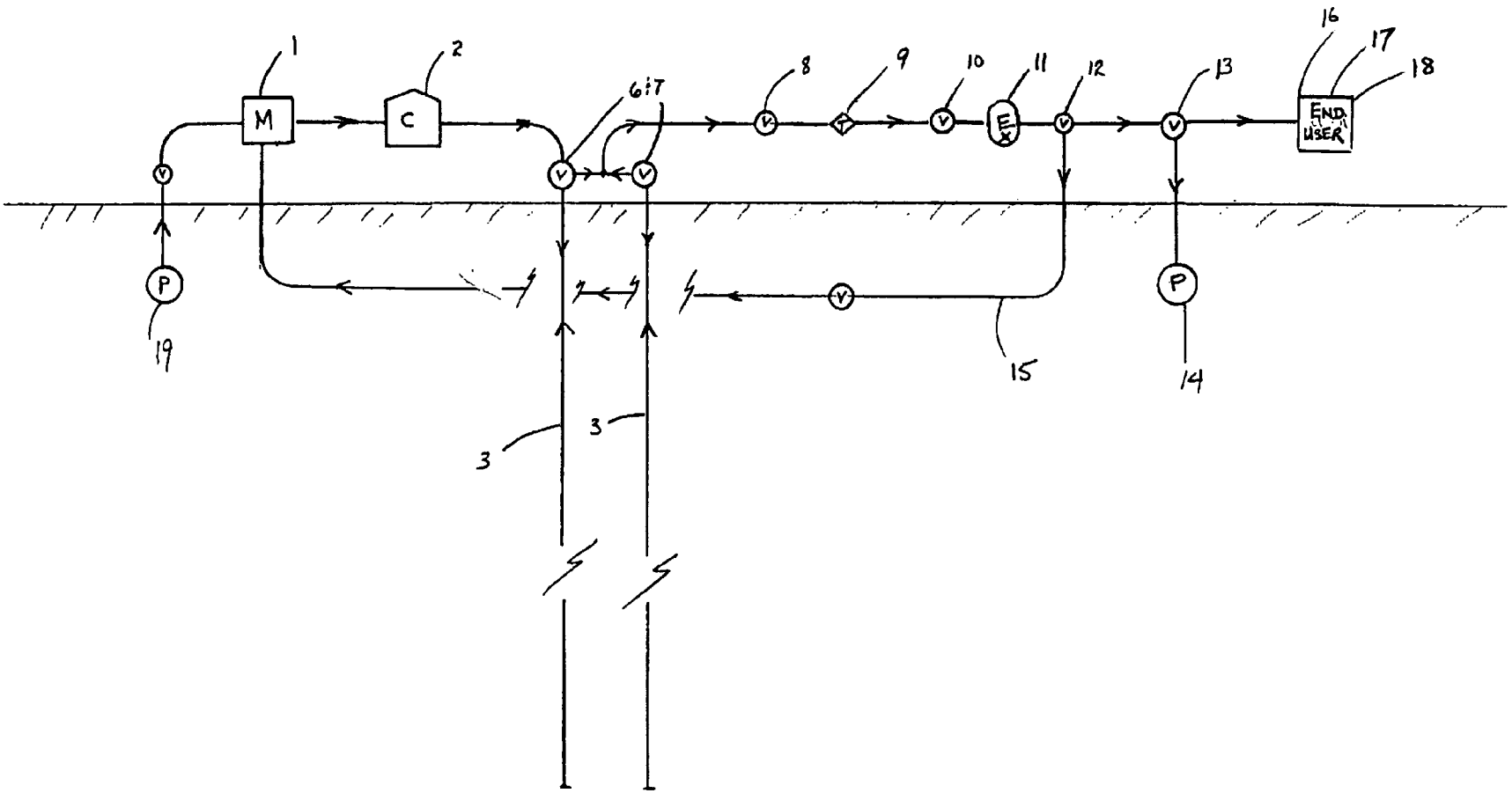
FIG. 2 is a schematic illustration of the invention's configuration for use by a local distribution company (LDC), and/or, an electrical power generator and/or, an intrastate or interstate pipeline, and/or, a residential, commercial, industrial or other end-user and/or, an operator of an electrical switch yard with transformers and/or, a storage operator or third party balancing agent and/or, a fossil fuel or nuclear plant or other facility requiring the cooling of fluids, such as water, prior to them being discharged to a sink or the environment or to a open or closed cycle system.
Figure 3:
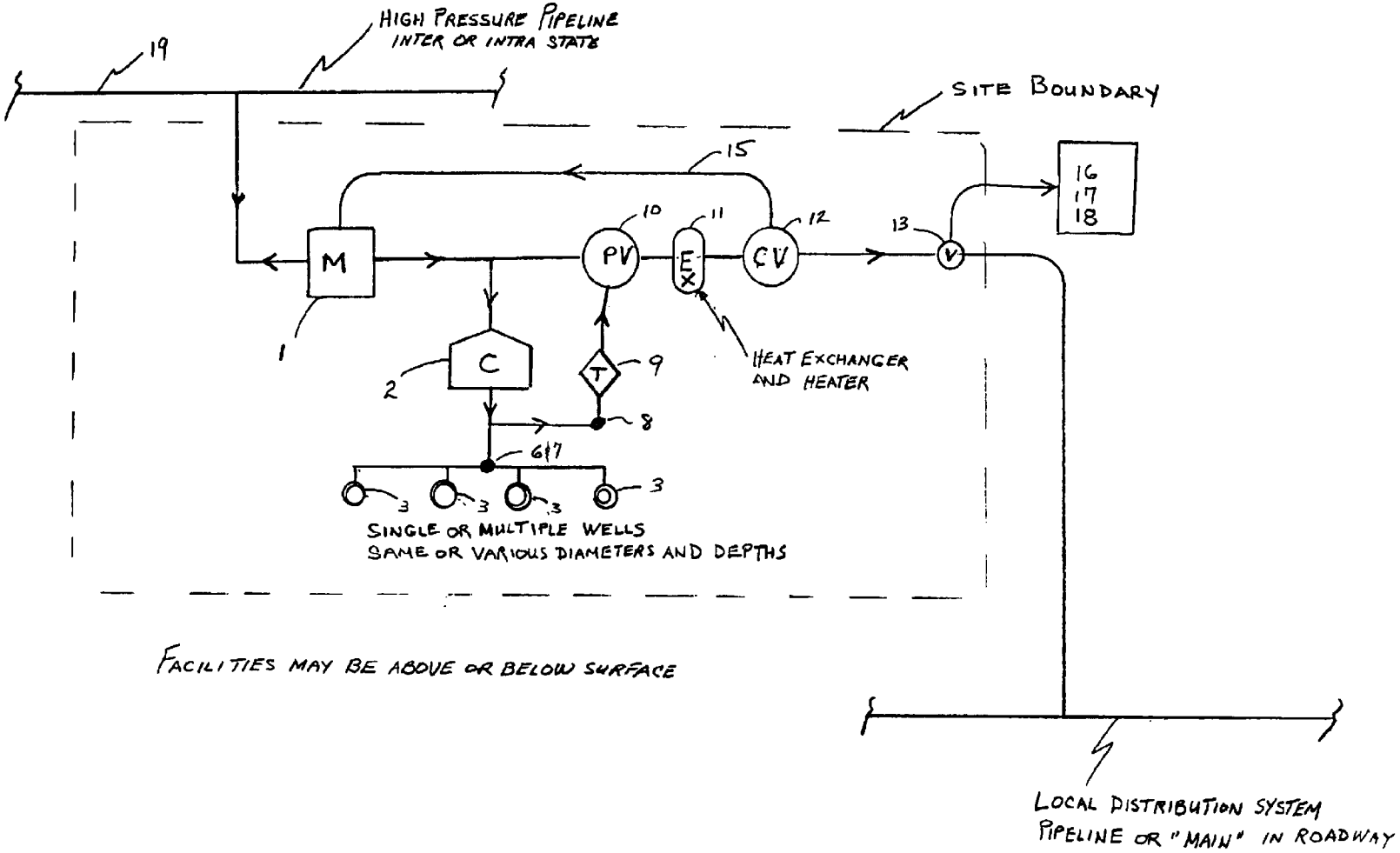
FIG. 3 is a plot plan view of FIG. 2.

With reference to FIG. 2 and FIG. 3, additional systems, uses and processes related to the invention will be described in greater detail.

FIG. 2 is a profile illustration of FIG. 1 above plus configurations which provide the valves to direct gas to various use options. For example, flow control valves 12 are utilized in path as gas flows through to valving 13 to direct the gas to any or all of the systems and processes designed for consumption and/or utilization. Piping 15 can be installed to flow gas back through standard measurement equipment which is set-up for bi-directional flow or a new meter and into the original source of the gas 19. The gas could also be directed into a local utility gas main 14. Also, the gas could be directed to a residential or commercial user 16, an industrial user 17 or a power generator 18.

For example, a local distribution company (LDC) could locate these systems (FIGS. 2, 3) within their delivery franchise area to provide peak storage, air-conditioning, generate peak power and provide PROFILING services.

This installation would be of benefit to the rate payers of the LDC as it would result in overall lower costs, increased efficiencies and increased abilities to meet growing needle peaks and needle balancing. Thus, this system could become part of the rate base of an LDC while also mitigating costs.

Also, for example, a power generator could utilize this system (FIGS. 2, 3) to provide gas to its turbines on a non-uniform basis significantly reducing its transmission charges and mitigating its exposure to potential transmission system imposed penalties, restrictions and/or curtailment. The system could also be used to harness the cooling affect of the expanding gas to enhance the operating efficiency of its power generation turbines or engines.

Also, for example, a intrastate or interstate transmission pipeline could utilize the system (FIGS. 2, 3) to increase their ability to provide PROFILING services, increase capacity and reduce costs associated with the cooling of gas at the discharge side of compressors (ie: after cooler costs). The incorporation of turbo-expanders will also be of benefit to increase efficiencies and reduce costs.

Also, for example, a direct commercial, residential or industrial consumer could utilize the system (FIGS. 2, 3) to store gas, provide their own PROFILING services, create electrical power through turbo-expanders or other generators or engines, and create their own air-conditioning.

Also, for example, operators of electrical switch yards and transformers could utilize the system (FIGS. 2, 3) to harness the cooling affect of expanding gas during peak electrical demand days to increase the efficiency of these facilities.

Also, for example, storage operators could utilize this system (FIGS. 2, 3) to begin to offer PROFILING services to its customers as third party balancing agents. These systems, for example, could also be fitted with TURBO-GENERATORS, to provide peak electrical power generation at the same time there is a need to provide needle balancing or PROFILING to its customers. The system can also be utilized to create hourly electrical power when commodity spreads or need merit.

Also, for example, power plant operators and others could utilize this system (FIGS. 2, 3) to comply with environmental regulations requiring them to cool heated water that is heated during the plant operation prior to it being discharged into the environment.

For any and/or all examples addressed above, the well(s) and system can also be incorporated with electronic communication devices to automate them such that they can be controlled remotely and automatically from any location. This could also potentially require the system (distributed storage using well(s)) to be incorporated into other gas transmission or delivery systems such as, but not limited to, direct end-user delivery lines, local distribution systems, interstate pipelines and traditional under ground natural gas storage facilities to enhance operational efficiencies and uses.

Additionally, the well-bore of the well(s) (Existing and/or new, to be drilled) consisting of the invented system and processed may or may not also be fitted with expandable casing (Enventure—a Joint Venture between Shell and Halliburton) to reseal perforations or otherwise provide a method to contain compressed natural gas within the well-bore at low and high or any variety or range of operating pressures which may change quite often due to the cycling schedule and depending on the specific system process design as further discussed and contained within this patent application.

The present invention provides a system and method for the use, cycling and storage of compressed natural gas within existing drilled wells, either dry holes, abandoned or actively producing wells and/or new, to be drilled, wells or any other well(s) located, sited, designed, drilled and fabricated to store and cycle compressed natural gas or other gasses within the contained cavity of the well-bore casing in any volume and with any degree (high or low) of deliverability.

Each of the well(s) can then be incorporated with additional facilities, depending upon designed use and process, such as compressors, pressure reducing regulators, heat exchangers, temperature absorbers, turbo-compressors (for electrical and/or mechanical power creation), distributed power generator engines, in-line measurement equipment and other components for compressing and storing the gas within the system at a range of rates, and then cycling the gas out of the well(s) for a number of business applications, including but not limited to, industrial & commercial, & residential use, consumption and profiling of gas requirements, power generation use, consumption and profiling of gas needs, local distribution company use, consumption and profiling of gas needs, interstate pipeline use, consumption and profiling of gas needs, creation of air conditioning, industrial gasses and ice, enhancing the efficiency of switch yards, electrical transformers, compressors and other business and non-business applications. The system design would incorporate all components required to operate within the parameters of its designed utilization and within the operating parameters of any system(s) it may be incorporated in a safe and environmentally acceptable manner.

Depending on the specific process and/or business application, which are numerous, associated with the well(s) and the total created system (distributed storage using well (s)), each system configuration will be subject to change, however, the constant component's will always be the incorporation of the well(s) within the system(s) and the connected processes and business and non-business uses contained within this patent application.

What is claimed is:

1. A method of storing and cycling gas within a natural gas delivery infrastructure including a plurality of conduits between at least one gas source and a plurality of gas consumers to accommodate non-uniform demand, comprising:

providing at least one gas storage facility comprising a sealed well bore;

providing means for monitoring the rate of gas demand by at least one of the plurality of gas consumers;

transferring gas to the at least one storage facility;

storing gas in the at least one storage facility when demand is at or below a first predetermined rate; and transferring gas from the at least one storage facility to the delivery infrastructure or the at least one gas consumer when demand is above the predetermined rate.

2. The method of claim 1, wherein the well bore is selected from the group consisting of existing natural gas wells and oil wells.

3. The method of claim 2, further comprising casing the well bore.

4. The method of claim 3, wherein the casing comprises an expandable casing.

5. The method of claim 1, further comprising drilling the at least one well bore.

6. The method of claim 1, wherein the well bore is at least 500 feet deep.

7. The method of claim 1, wherein the well bore is at least 1000 feet deep.

8. The method of claim 1, wherein the well bore is at least 3000 feet deep.

9. The method of claim 1, wherein the gas is natural gas.

10. The method of claim 1, further comprising providing a plurality of well bores at different locations.

11. The method of claim 1, further comprising compressing gas into the storage well and decompressing gas our of the storage well to the infrastructure or at least one consumer.

12. The method of claim 11, further comprising applying cooling from the decompressing gas to cool a material.

13. The method of claim 1, further comprising providing a turbo-expander with a generator to provide electrical power from the stored gas.

14. The method of claim 1, further comprising providing a turbo-generator to provide electrical power from the stored gas.

15. The method of claim 1, further comprising providing heat transfer means for applying a cooling effect from decompressing the stored gas.

16. The method of claim 1, comprising providing a plurality of well bores at one or more different locations distributed throughout the infrastructure.

17. A method for making a distributed gas storage system including at least one well bore within a gas delivery infrastructure to accommodate profiling of natural gas delivery to consumer demand, comprising:

plugging the lower end of the at least one well bore;

casing the at least one well bore to provide an impermeable cavity for storing gas;

providing a conduit for transmission of gas between the at least one well bore and the gas delivery infrastructure or end user; and providing means for monitoring demand and controlling the flow of gas between the at least one well bore and the gas delivery infrastructure or end user to accommodate non-uniform gas demand.

18. The method of claim 17, wherein the at least one well bore is at least 500 feet deep.

19. The method of claim 17, wherein the at least one well bore is at least 1000 feet deep.

20. The method of claim 17, wherein the at least one well bore is at least 3000 feet deep.

21. The method of claim 17, further comprising drilling the well bore.

22. The method of claim 17, wherein casing comprises inserting an expandable casing material into the well bore.

23. The method of claim 22, wherein the expandable casing is capable of storing gas at a variety of gas pressures.

24. The method of claim 17, further comprising filling the annulus of the well bore at least partially full with a material selected from the group consisting of concrete and drilling mud.

25. The method of claim 17, further comprising providing means for compressing gas into the storage well and means for decompressing gas out of the storage well to the delivery system or end user.

26. The method of claim 17, further comprising providing remote control means for cycling gas out of the storage well to match non-uniform hourly end user demand.

27. The method of claim 17, wherein the at least one well bore comprises a plurality of existing oil or natural gas well bores at multiple locations within the area of the gas delivery infrastructure.

28. The method of claim 17, wherein the at least one well bore comprises an existing oil or gas well bore.

29. The method of claim 28, further comprising drilling and casing a plurality of well bores at different locations distributed throughout the gas delivery infrastructure.

30. The method of claim 17, further comprising providing a turbo-expander with a generator to provide electrical power from the stored gas.

31. The method of claim 17, further comprising providing a turbo-generator to provide electrical power from the stored gas.

32. The method of claim 17, further comprising providing heat transfer means for applying a cooling effect from decompressing the stored gas.

* * * * *